US009656778B2

(12) United States Patent
Kelly et al.

(10) Patent No.: US 9,656,778 B2
(45) Date of Patent: May 23, 2017

(54) PANEL BOARDS AND METHODS FOR MAKING CONTAINERS THEREFROM

(71) Applicant: Georgia-Pacific LLC, Atlanta, GA (US)

(72) Inventors: John P. Kelly, Sugar Hill, GA (US); Ronald C. Norris, Loganville, GA (US); Richard D. Jordan, Lawrenceville, GA (US)

(73) Assignee: Georgia-Pacific LLC, Atlanta, GA (US)

( * ) Notice: Subject to any disclaimer, the term of this patent is extended or adjusted under 35 U.S.C. 154(b) by 0 days.

(21) Appl. No.: 14/952,954

(22) Filed: Nov. 26, 2015

(65) Prior Publication Data

US 2016/0152372 A1 Jun. 2, 2016

Related U.S. Application Data

(60) Provisional application No. 62/085,317, filed on Nov. 27, 2014.

(51) Int. Cl.

| | |
|---|---|
| ***B65D 5/02*** | (2006.01) |
| ***B65D 5/64*** | (2006.01) |
| ***B65D 5/468*** | (2006.01) |
| ***B65D 5/42*** | (2006.01) |
| ***B65D 5/68*** | (2006.01) |
| ***B65D 5/10*** | (2006.01) |

(52) U.S. Cl.

CPC ..... *B65D 5/029* (2013.01); *B65D 5/106* (2013.01); *B65D 5/4266* (2013.01); *B65D 5/4608* (2013.01); *B65D 5/64* (2013.01); *B65D 5/68* (2013.01)

(58) Field of Classification Search

CPC ..... B65D 5/029; B65D 5/103; B65D 5/106
USPC ..... 229/109, 110, 148, 149, 150, 185
See application file for complete search history.

(56) References Cited

U.S. PATENT DOCUMENTS 2,021,559 A * 11/1935 Lengsfield ..... B65D 5/46024 229/109
2,123,147 A * 7/1938 Snyder ..... B65D 5/10 229/110
2,736,486 A * 2/1956 Rabby ..... B65D 5/10 229/110
3,245,604 A * 4/1966 Chapman ..... B65D 5/4279 229/142
4,003,515 A * 1/1977 Steele ..... B65D 5/46104 229/114

(Continued)

FOREIGN PATENT DOCUMENTS

WO WO-2013/158001 A1 * 10/2013 ..... B65D 5/029

*Primary Examiner* — Christopher Demeree
(74) *Attorney, Agent, or Firm* — Ram W. Sabnis

(57) ABSTRACT

A panel board can include a main body confined by an upper boundary, a lower boundary, a first side boundary, and a second side boundary. A plurality of folding lines can be disposed on the main body and can extend from the upper boundary to the lower boundary. The folding lines disposed on the main body can provide a plurality of panels. A base having multiple sides can extend from the lower boundary of the main body. One or more locking tabs can extend from one or more sides of the base and one or more locking tabs can extend from the lower boundary of the main body. One or more locking slots can be disposed through the panel board about the lower boundary of the main body.

20 Claims, 6 Drawing Sheets

(56) References Cited

U.S. PATENT DOCUMENTS

| | | | | |
|---|---|---|---|---|
| 4,856,705 | A * | 8/1989 | Carr | B65D 5/3614 229/109 |
| 5,050,775 | A * | 9/1991 | Marquardt | B65D 77/065 222/105 |
| 8,950,654 | B2 * | 2/2015 | Schultz | B65D 5/3635 229/109 |

* cited by examiner

PANEL BOARDS AND METHODS FOR MAKING CONTAINERS THEREFROM

CROSS-REFERENCE TO RELATED APPLICATION

This application claims priority to U.S. Provisional Patent Application No. 62/085,317, filed on Nov. 27, 2014, which is incorporated by reference herein.

BACKGROUND

Field

Embodiments described generally relate to panel boards, methods for making containers therefrom, and the containers.

Description of the Related Art

A variety of portable containers have been made available for the transportation and storage of beverages and/or other consumables such as food. Such places where portable containers have been used by individuals or groups of individuals include various traveling destinations, such as picnics, sporting events, fishing trips, etc. It is often desirable to keep the beverages or other items brought along in a cooled or chilled environment to preserve taste and freshness.

Typically, portable containers for the transportation and storage of beverages are made out of hard plastics, resulting in a cooler container that is both heavy and bulky, and is quite often expensive. Travelers may choose to use a disposable container option. Current disposable container options, however, do not provide a traveler with a container that is durable, cost effective, light weight, and that can be stored in a manner that does not take up a lot of space until the container is needed.

There is a need, therefore, for improved containers for the storage of beverages and/or other consumables such as food.

SUMMARY

Panel boards, methods for making containers therefrom, and the containers are provided. In one or more examples, the panel board can include a main body having a front surface and a back surface. The main body can be confined by an upper boundary, a lower boundary, a first side boundary, and a second side boundary, where each of the first side boundary and the second side boundary extend between the upper boundary and the lower boundary. A first folding line can be disposed on the front surface and can extend between the upper boundary and the lower boundary, where a first panel can be confined between the first side boundary, the first folding line, the upper boundary, and the lower boundary. A second folding line can be disposed on the front surface and can extend between the upper boundary and the lower boundary, where a second panel can be confined between the first folding line, the second folding line, the upper boundary, and the lower boundary. A third folding line can be disposed on the front surface and can extend between the upper boundary and the lower boundary, where a third panel can be confined between the second folding line, the third folding line, the upper boundary, and the lower boundary. A fourth folding line disposed on the front surface and can extend between the upper boundary and the lower boundary, where a fourth panel can be confined between the third folding line, the fourth folding line, the upper boundary, and the lower boundary. A fifth folding line can be disposed on the front surface and can extend between the upper boundary and the lower boundary, where a fifth panel can be confined between the fourth folding line, the fifth folding line, the upper boundary, and the lower boundary, and where a sixth panel can be confined between the fifth folding line, the second side boundary, the upper boundary, and the lower boundary. A first base can extend from the lower boundary of the main body, and the first base can have six or more sides. A first locking tab and a second locking tab can each extend from at least one of the six or more sides of the first base. A third locking tab can extend from the lower boundary of the main body. A first locking slot and a second locking slot can be disposed through the panel board about the lower boundary of the main body. In some examples, a second base can extend from the lower boundary of the main body.

In some examples, a method for assembling a container can include positioning and folding the panel board at the folding lines. The first side boundary of the main body can be connected to the second side boundary of the main body. The main body can be bent or otherwise folded at the first, second, third, fourth, and fifth folding lines to provide an internal volume. A bottom side of the container can be assembled by folding the first base and the second base across the internal volume and inserting the first locking tab into the first locking slot and the second locking tab into the second locking slot.

In other examples, a container can include a main body and a bottom side. The main body can include an upper boundary and a lower boundary. The main body can also include six or more panels separated from one another by folding lines, where each panel can extend between the upper boundary and the lower boundary. The main body can also include one or more locking slots, each disposed through the main body about the lower boundary. The bottom side can include a first layer, and the first layer can have a first base with six or more sides. One or more locking tabs can extend from one or more of the sides of the base. Each locking tab can be disposed through one of the one or more locking slots.

DETAILED DESCRIPTION

Figure 1:
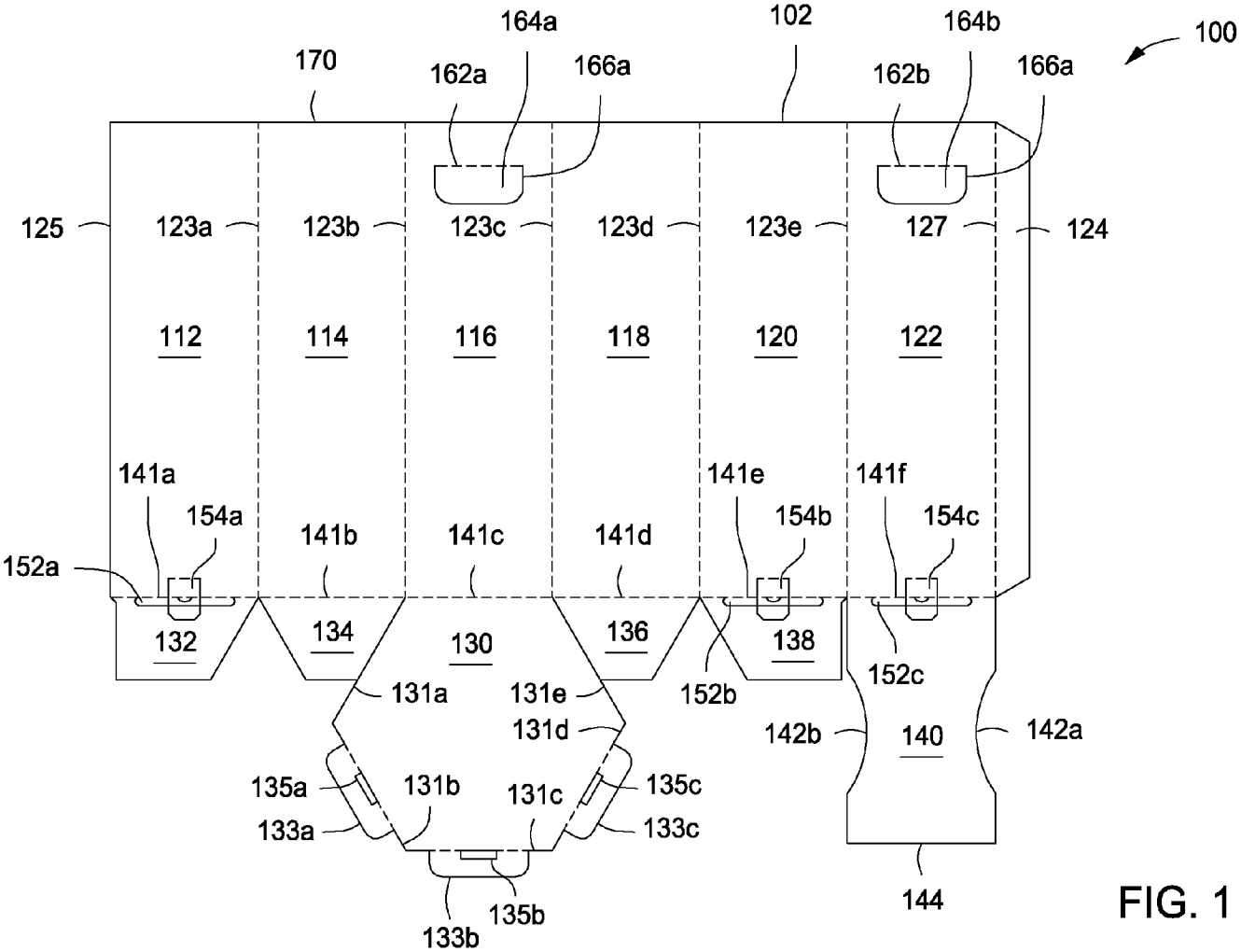
FIG. 1 depicts a perspective view of an illustrative panel board, according to one or more embodiments described.

FIG. 1 depicts a perspective view of an illustrative panel board 100. The panel board 100 can generally be flat and can have a front surface and a back surface. The panel board 100 can include a main body 102 and one or more bases (two are shown) 130, 140. The panel board 100 can also include one or more support flaps (four are shown) 132, 134, 136, 138 and one or more connection flaps 124. The main body 102 can include an upper boundary 170, a lower boundary 141*a*-141*f*, a first side boundary 125, and a second side boundary 127. The first side boundary 125 and/or the second side boundary 127 can extend between the upper boundary 170 and the lower boundary 141*a*-141*f*. For example, first side boundary 125 and/or the second side boundary 127 can extend generally perpendicularly between the upper boundary 170 and the lower boundary 141*a*-141*f*.

One or more folding lines can be disposed or located on, in, along, or otherwise about the front surface and/or the back surface of the panel board 100. The folding lines disposed or located on, in, along, or otherwise about the panel board 100 can separate, divide, or otherwise segment the panel board 100 into two or more sections. Any or all of the folding lines disclosed herein can serve as an at least partial boundary, an at least partial edge or side, an at least partial borderline, or an at least partial outer limit of a section of the panel board 100. In one or more examples, the folding lines can be or include a mark, an indentation, or a line disposed or located on, in, along, or otherwise about the panel board 100. In one or more examples, the folding lines can be formed by crushing or indenting the panel board 100 along a predetermined line to facilitate bending of the panel board 100. The folding lines can be formed by a mark, pencil or ink line, groove, score, scratch, perforation, bulge, bend, indentation, or crease disposed on, in, along, or otherwise about the panel board 100. In one or more examples, the folding lines can be an intended location at which the panel board 100 can be folded along. As such, any one or more of the folding lines can be only an intended location at which the panel board 100 can be folded and no mark, indentation, line, or other visual or structural indication may be present. In one or more examples, the folding lines can be formed when or as the panel board 100 is folded.

One or more of the folding lines can extend between the upper boundary 170 and the lower boundary 141*a*-141*f*. As a result, the folding lines can, at least in part, define one or more segments, sections, side panels, or panels (six are shown) 112, 114, 116, 118, 120, and 122 between the upper boundary 170 and the lower boundary 141*a*-141*f* of the main body 102. For example, a first folding line 123*a* can extend between the upper boundary 170 and the lower boundary 141*a*-141*f*, and can provide a boundary for the first panel 112. The first panel 112 can be confined between and have an outer boundary provided by the first side boundary 125, the first folding line 123*a*, a first segment of the upper boundary 170 (between the first side boundary 125 and the first folding line 123*a*), and a first segment 141*a* of the lower boundary 141*a*-141*f*. A second folding line 123*b* can extend between the upper boundary 170 and the lower boundary 141*a*-141*f*, and can provide a boundary for the second panel 114. The second panel 114 can be confined between and thus have an outer boundary provided by the first folding line 123*a*, the second folding line 123*b*, a second segment of the upper boundary 170 (between the first folding line 123*a* and the second folding line 123*b*), and a second segment 141*b* of the lower boundary 141*a*-141*f*. A third folding line 123*c* can extend between the upper boundary 170 and the lower boundary 141*a*-141*f*, and can provide a boundary for the third panel 116. The third panel 116 can be confined between and thus have an outer boundary provided by the second folding line 123*b*, the third folding line 123*c*, a third segment of the upper boundary 170 (between the second folding line 123*b* and the third folding line 123*c*), and a third segment 141*c* of the lower boundary 141*a*-141*f*. A fourth folding line 123*d* can extend between the upper boundary 170 and the lower boundary 141*a*-141*f*, and can provide a boundary for the fourth panel 118. The fourth panel 118 can be confined between and thus have an outer boundary provided by the third folding line 123*c*, the fourth folding line 123*d*, a fourth segment of the upper boundary 170 (between the third folding line 123*c* and the fourth folding line 123*d*), and a fourth segment 141*d* of the lower boundary 141*a*-141*f*. A fifth folding line 123*e* can extend between the upper boundary 170 and the lower boundary 141*a*-141*f*, and can provide a boundary for the fifth panel 120. The fifth panel 120 can be confined between and thus have an outer boundary provided by the fourth folding line 123*d*, the fifth folding line 123*e*, a fifth segment of the upper boundary 170 (between the fourth folding line 123*d* and the fifth folding line 123*e*), and a fifth segment 141*e* of the lower boundary 141*a*-141*f*. The sixth panel 122 can be confined between and thus have an outer boundary provided by the fifth folding line 123*e*, the second side boundary 127, a sixth segment of the upper boundary 170 (between the fifth folding line 123*e* and the second side boundary 127), and a sixth segment 141*f* of the lower boundary 141*a*-141*f*. In one or more examples, 2, 3, 4, 5, 6, 7, 8, 9, 10, or more folding lines can extend between the upper boundary 170 and the lower boundary 141*a*-141*f* of the main body 102 to provide boundaries for 3, 4, 5, 6, 7, 8, 9, 10, 11, or more panels, respectively.

A first base 130 can extend from or otherwise be connected to the lower boundary 141*a*-141*f* of the main body 102. The first base 130 can have any desired shape. For example, the first base 130 can have a polygonal shape. The first base 130 can have a plurality of sides, and the number of sides of the first base 130 can be the same as the number of panels in main body 102. For example, the first base 130 can have 3, 4, 5, 6, 7, 8, 9, 10, 11, 12, or more sides. As shown in FIG. 1, the first base 130 can have six sides including five sides 131*a*, 131*b*, 131*c*, 131*d*, 131*e* and the third segment 141*c*. The first base 130 can extend from the lower boundary 141*a*-141*f* of the main body 102 at or about any one of the segments 141*a*, 141*b*, 141*c*, 141*d*, 141*e*, and/or 141*f* of the lower boundary 141*a*-141*f*. For example, the first base 130 can extend from the third segment 141*c* of the lower boundary 141*a*-141*f*, and the sixth side of the first base 130 can be at, or the same as, the third segment 141*c* of the lower boundary 141*a*-141*f* of the main body 102. In another example, the first base 130 can extend from the fourth segment 141*d* of the lower boundary 141*a*-141*f*. The total length of the sides 131*a*-131*e* and the third segment 141*c* of the first base 130 (e.g., the perimeter) can be about the same as, exactly the same as, or similar to the length of the lower boundary 141*a*-141*f* of the main body 102.

One or more locking tabs (three are shown) 133*a*, 133*b*, 133*c* can extend from or otherwise be connected to the first base 130. For example, the locking tabs 133*a*-133*c* can extend from any one of the sides 131*a*, 131*b*, 131*c*, 131*d*, and/or 131*e* of the first base 130. A folding line can be disposed between each locking tab 133*a*-133*c* and the side 131*a*-131*e* from which the locking tab 133*a*-133*c* extends. For example, a first locking tab 133*a* can extend from the side 131*b* of the first base 130, a second locking tab 133*b* can extend from the side 131*c* of the first base 130, and a third locking tab 133*c* can extend from the side 131*d* of the first base 130. The locking tabs 133*a*-133*c* can have the same, similar, or different shapes and/or sizes with respect to one another. Any one or more of the locking tabs 133*a*-133*c* can extend along the full length of the sides 131*a*-131*e* of the first base 130. Alternatively, any one or more of the locking tabs 133*a*-133*c* can extend a portion of the length of any side 131*a*-131*e* of the first base 130. For example, any one or more of the locking tabs 133a-133c can be about 20%, about 30%, about 50%, or about 75% of the length of the corresponding side 131a-131e of the first base 130. In another example, any one or more of the locking tabs 133a-133c can be about 10% to about 100%, about 25% to about 80%, or about 40% to about 60% of the length of the side 131a-131e of the first base 130 from which the locking tab 133a-133c extends.

One or more locking slots (three are shown) 135a, 135b, 135c can be disposed through, formed within, or at least partially defined by one or more of the locking tabs 133a-133c. The locking slots 135a-135c can be an opening or a hole in the locking tabs 133a-133c through which a corresponding locking tab (e.g., any one of locking tabs 154a-154c) can be at least partially disposed in. The locking slots 135a-135c can be formed within the locking tabs 133a-133c, along a side 131b-131d of the first base 130, through the first base 130, or any combination thereof. In one or more examples, the locking slots 135a-135c can be disposed about a center of the locking tabs 133a-133c and can be disposed near, about, and/or parallel to the side 131a-131e of the first base 130 from which the locking tab 133a-133c extends. The locking slots 135a-135c can be disposed in and/or disposed through the first base 130, the locking tabs 133a-133c, along the folding line located between the side 131b-131d of the first base 130 and any locking tab 133a-133c extending therefrom, or any combination thereof.

A second base 140 can extend from or otherwise be connected to the lower boundary 141a-141f of the main body 102. For example, the second base 140 can extend from the first segment 141a of the lower boundary 141a-141f, and the first segment 141a of the lower boundary 141a-141f can include a folding line. In another example, the second base 140 can extend from the sixth segment 141f of the lower boundary 141a-141f, and the sixth segment 141f of the lower boundary 141a-141f can include a folding line. The second base 140 can be any desired shape. For example, the second base 140 can be polygonal. The second base 140 can have a plurality of sides. For example, the second base 140 can have 1, 2, 3, 4, 5, 6, 7, 8, or more sides.

In one or more examples, the second base 140 can include a first side 142a, a second side 144, a third side 142b, and a fourth side at, or the same as, the sixth segment 141f of the lower boundary 141a-141f. The second base 140 can have a generally rectangular shape. The number of sides of the second base 140 can be less than, the same as, or greater than the number of sides of the first base 130. The number of sides of the second base 140 can be less than, the same as, or greater than the number of panels in the main body 102. In one or more examples, the first and third sides 142a, 142b can be or include a curved shape or curved portion. The curved shape or portion can be concave, convex, or a combination thereof. Though not shown, one or more locking tabs can extend from any one or more sides 142a, 144, 142b, and/or 141f of the second base 140, and a folding line can be disposed along the boundary between the locking tab and the second base 140. A locking tab extending from the second base 140 can correspond with, and/or be configured to insert into, a locking slot (e.g., 152a-152c) disposed through the panel board 100 about the lower boundary 141a-141f of the main body 102.

Each of the one or more support flaps 132, 134, 136, 138 can extend from or otherwise be connected to the lower boundary 141a-141f of the main body 102. For example, each of the one or more support flaps 132, 134, 136, 138 can extend from the lower boundary of the main body 102 at or about any one of the segments 141a, 141b, 141c, 141d, 141e, and/or 141f of the lower boundary 141a-141f. In some examples, the first support flap 132 can extend from the first segment 141a of the lower boundary 141a-141f of the main body 102, the second support flap 134 can extend from the second segment 141b of the lower boundary 141a-141f of the main body 102, the third support flap 136 can extend from the fourth segment 141d of the lower boundary 141a-141f of the main body 102, and the fourth support flap 138 can extend from the fifth segment 141e of the lower boundary 141a-141f of the main body 102.

Each of the support flaps 132, 134, 136, 138 can have any desired shape. For example, the support flaps 132, 134, 136, and 138 can be polygonal. Each support flap 132, 134, 136, 138 can have 3, 4, 5, 6, 7, 8, or more sides.

One or more locking tabs (three are shown) 154a, 154b, 154c can extend from or otherwise be connected to the lower boundary 141a-141f of the main body 102. The locking tabs 154a-154c can be formed by a cut in the panel board 100. For example, the locking tabs 154a-154c can be formed by a cut across the lower boundary 141a-141f of the main body 102 and into the first base 130, the second base 140, and/or the support flap 132, 134, 136, 138 extending therefrom. In one or more examples, any one of the locking tabs 133a-133c, 154a-154c can include a piece or attachment that is not an integral part of the panel board 100, but can otherwise be attached to or disposed on the panel board 100.

One or more locking slots (three are shown) 152a, 152b, 152c can be disposed through and/or disposed in the panel board 100 about the lower boundary 141a-141f of the main body 102. A locking slot 152a-152c can be disposed through the one of the panels 112, 114, 116, 118, 120, 122. A locking slot 152a-152c can be disposed through the first base 130, the second base 140, one or more of the support flaps 132, 134, 136, 138, or any combination thereof. A locking slot 152a-152c can be disposed through the panel board 100 along the lower boundary 141a-141f of the main body 102 and/or any segment 141a, 141b, 141c, 141d, 141e, 141f of the lower boundary 141a-141f. For example, a locking slot 152a-152c can be disposed through the panel board 100 at a folding line separating any one of the first base 130, the second base 140, or any one or more support flaps 132, 134, 136, 138 from the main body 102. As shown, a first locking slot 152a can be disposed along the first segment 141a of the lower boundary 141a-141f, a second locking slot 152b can be disposed along the fifth segment 141e of the lower boundary 141a-141f, and a third locking slot 152c can be disposed along the sixth segment 141f of the lower boundary 141a-141f. The locking slots 152a-152c can correspond to the locking tabs 133a-133c extending from a side 131a-131e, 141c of the first base 130 and/or the second base 140.

One or more handles (two are shown) 164a and 164b can be disposed through, disposed in, and/or disposed on the panel board 100. More particularly, one or more handles 164a, 164b can be disposed through, disposed in, and/or disposed on one or more "designated panels," e.g., any one or more of the panels 112, 114, 116, 118, 120, 122. For example, as shown in FIG. 1, the first handle 164a can be disposed in the third panel 116 and the second handle 164b can be disposed in the sixth panel 122. The handles 164a, 164b can be located closer to the upper boundary 170 of the main body 102 than the lower boundary 141a-141f of the main body 102. Any number of handles can be disposed in any one or more of the panels 112, 114, 116, 118, 120, 122. For example, any one of the panels 112, 114, 116, 118, 120, 122 can have 1, 2, 3, 4, 5, 6, or more handles disposed therein and/or thereon. The handles 164a, 164b can be disposed about or toward the upper boundary 170 of any panel 112, 114, 116, 118, 120, 122, about the middle of any panel 112, 114, 116, 118, 120, 122, about or toward the lower boundary 141*a*-141*f* of any panel 112, 114, 116, 118, 120, 122, or any combination thereof. Each handle 164*a*, 164*b* can have any structure or can include any apparatus suitable for a person and/or a tool or other device to hold, lift, or otherwise maneuver the panel board 100 or a container (not shown) made therefrom. In one or more examples, the handles 164*a*, 164*b* can be positioned such that a user can carry the container comfortably and/or conveniently with one or two hands.

The handles 164*a* and 164*b* can include a cut 166*a* made in or through the designated panel. A generally U-shaped cut 166*a* can be made in the designated panel such that the portion of the panel inside the U-shaped cut 166*a* can be folded along the folding lines 162*a*, 162*b*. Alternatively, not shown, one or more cuts 166*a* and/or one or more folding lines 162*a*, 162*b* can be made in the designated panel can include any shape suitable to provide a handle, e.g., V-shaped, T-shaped, B-shaped, elliptically-shaped, circularly-shaped, O-shaped, triangularly-shaped, square-shaped, rectangular-shaped, or other shapes. Though not shown, the handles 164*a*, 164*b* can be reinforced by a suitable material for the purpose of increasing the integrity of the handles 164*a*, 164*b*. For example, an overlay and/or coating can be placed on the panel board 100 at the position of the handles 164*a*, 164*b* where the overlay and/or coating decreases the likelihood of ripping and/or tearing the panel board 100.

In one or more examples, the handles 164*a*, 164*b* can include a device attached to the panel board 100. For example, the handles 164*a*, 164*b* can include, but are not limited to, one or more of: strap, string, rope, cardboard segment, paper segment, or any suitable device that can be secured or otherwise attached to the panel board 100, e.g., through one or more designated panels. In one configuration, the handles 164*a*, 164*b* can include a piece of rope that can be disposed through one or more panels and can be configured to allow a user to take hold of the rope.

Figure 3:
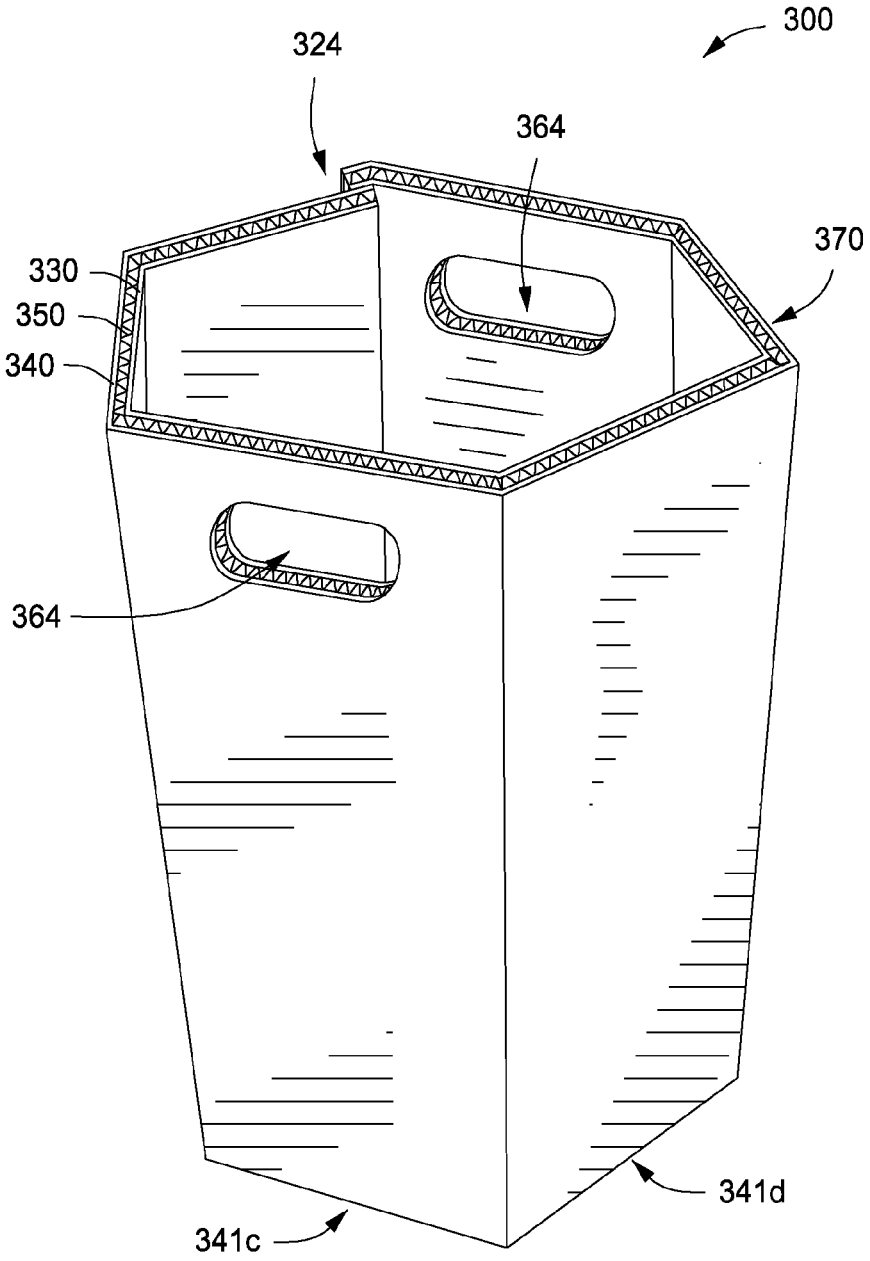
FIG. 3 depicts an isometric view of an illustrative container, according to one or more embodiments described.

The panel board 100 can be folded or otherwise assembled into a container, e.g., the illustrative container 300 depicted in FIG. 3. Assembly of the container can include forming a main body of the container and a bottom side of the container. The main body 102 of the panel board 100 can be made into or otherwise form the assembled main body of a container by connecting the first side boundary 125 of the main body 102 to the second side boundary 127 of the main body 102. Connecting the first side boundary 125 to the second side boundary 127 can include folding the main body 102 along any one or more of the folding lines 123*a*-123*e* disposed thereon. When the main body 102 of the container is assembled, the panel 112 can generally oppose the panel 118, the panel 114 can generally oppose the panel 120, and the panel 116 can generally oppose the panel 122. The handles 164*a*, 164*b* can be disposed on at least one set of opposing panels.

The first and second side boundaries 125, 127 of the main body 102 can be connected by one or more suitable attachment devices, e.g., one or more connection flaps 124. The connection flap 124 can extend from the second side boundary 127 of the main body 102. The connection flap 124 can be configured to connect to the surface of the first side boundary 125 of the main body 102. For example, the connection flap 124 can be glued, stapled, pinned, pressed, or otherwise connected to the first side boundary 125. Alternatively, the connection flap 124 can extend from the first side boundary 125 and can be configured to connect to the second side boundary 127. In some examples, one or more connection flaps 124 can extend from both the first and the second side boundaries 125, 127. For example, the connections flaps 124 can be sized or otherwise configured to overlap such that the first side boundary 125 is disposed about the second side boundary 127. In other examples, not illustrated, the connection flap 124 can be absent from the panel board 100.

Figure 2:
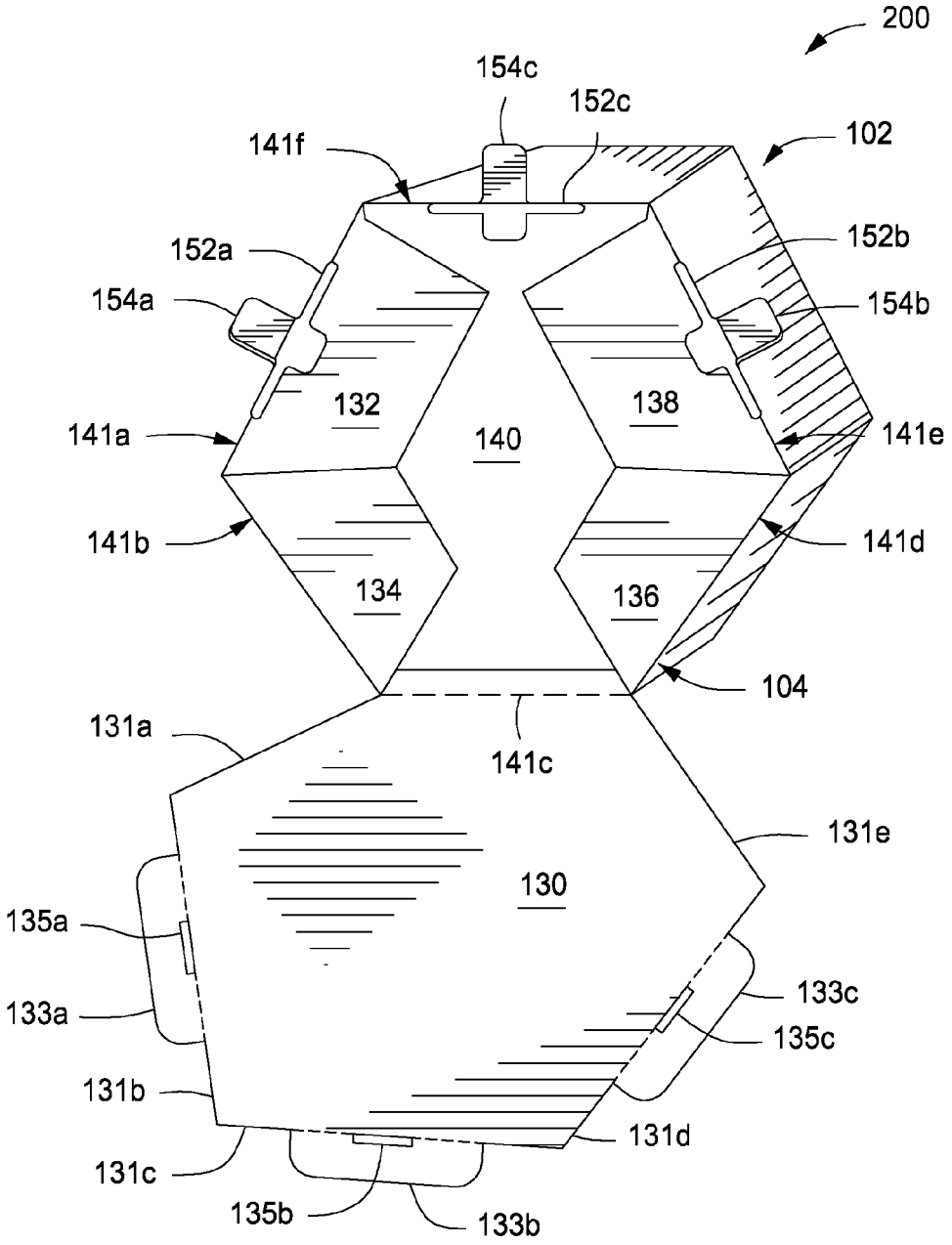
FIG. 2 depicts a bottom, isometric view of an illustrative partially assembled container, according to one or more embodiments described.

FIG. 2 depicts a bottom view of an illustrative partially assembled container 200. The partially assembled container 200 can be a derivative product of or can be formed from the panel board 100, discussed and described above in reference to FIG. 1. As illustrated in FIG. 2, a bottom side 104 of the partially assembled container 200 can be formed or otherwise assembled by positioning the panel board 100 at desired angles and inwardly folding each of the first base 130, the second base 140, and the support flaps 132, 134, 136, 138 along the lower boundary 141*a*-141*f* of the main body 102. When assembled, the front surface of the panel board 100 can become an inner surface of the container and the back surface of the panel board 100 can become an outer surface of the container.

In one or more examples, the bottom side 104 can include one or more layers, two or more layers, three or more layers, four or more layers, five or more layers, or six or more layers. The layers of the bottom side 104 of the container can be assembled in any order. For example, a first or inner most layer can be formed by the second base 140, a second or middle layer can be formed by the support flaps 132, 134, 136, 138, and a third or outer most layer can be formed by the first base 130.

The second base 140 can be folded inward along the sixth segment 141*f* of the lower boundary 141*a*-141*f* to form the first or inner most layer of the bottom side 104. The second base 140 can be configured to extend across the bottom of the main body 102, and can have a length such that the second base 140 touches, or nearly touches the opposing third segment 141*c* of the lower boundary 141*a*-141*f*.

The support flaps 132, 134, 136, 138 can be folded inwardly to form the second or middle layer of the bottom side 104. For example, the first support flap 132 can be folded along the first segment 141*a* of the lower boundary 141*a*-141*f*, the second support flap 134 can be folded along the second segment 141*b* of the lower boundary 141*a*-141*f*, the third support flap 136 can be folded along the fourth segment 141*d* of the lower boundary 141*a*-141*f*, and the fourth support flap 138 can be folded along the fifth segment 141*e* of the lower boundary 141*a*-141*f*. The size and shape of each of the support flaps 132, 134, 136, 138 can be configured to form a single layer or to be located in a single layer such that the support flaps 132, 134, 136, 138 do not overlap with one another.

The first base 130 can be folded inwardly to form the third layer of the bottom side 104. The first base 130 can be of the same or similar size and shape formed by the assembled main body 102, and, consequently, each side 131*a*-131*e*, 141*c* of the first base 130 can generally have the same length of a corresponding segment of the lower boundary 141*a*-141*f* of the main body 102. As shown in FIG. 2, the assembled main body 102 has a hexagonal shape formed by the segments 141*a*, 141*b*, 141*c*, 141*d*, 141*e*, and/or 141*f* of the lower boundary 141*a*-141*f* of the main body 102. The first base 130 can have a generally matching hexagonal shape so that the first base 130 can cover the entire bottom side 104 or substantially all of the bottom side 104 of the container 200. In other words, when the first base 130 is folded along the third segment 141*c* of the lower boundary 141*a*-141*f*, the first side 131*a* of the first base 130 corresponds with the second segment 141*b* of the lower boundary 141*a*-141*f*, the second side 131*b* of the first base 130 corresponds with the first segment 141*a* of the lower boundary 141*a*-141*f*, the third side 131*c* of the first base 130 corresponds with the sixth segment 141*f* of the lower boundary 141*a*-141*f*, the fourth side 131*d* of the first base 130 corresponds with the fifth segment 141*e* of the lower boundary 141*a*-141*f*, and the fifth side 131*e* of the first base 130 corresponds to the fourth segment 141*d* of the lower boundary 141*a*-141*f*.

Two or more portions or layers of the bottom side 104 of the container 200 can be secured together by one or more securing mechanisms and/or securing components. For example, the locking tabs 133*a*, 133*b*, and 133*c* extending from the first base 130 can be folded and then inserted into, or otherwise disposed through, the corresponding locking slots 152*a*, 152*c*, and 152*b*, respectively. As such, the locking tabs 133*a*-133*c* can be disposed through or about the lower boundary 141*a*-141*f* of the main body 102 at a position that corresponds with the locking slots 152*a*-152*c*. For additional security, the locking tabs 154*a*, 154*c*, and 154*b* can be folded and then inserted into locking slots 135*a*, 135*b*, and 135*c*, respectively. For example, the locking tab 133*a* can be folded and inserted into the locking slot 152*a*, and then the locking tab 154*a* can be folded and inserted into the locking slot 135*a*. The locking tab 133*b* can be folded and inserted into the locking slot 152*c*, and then the locking tab 154*c* can be folded and inserted into the locking slot 135*b*. The locking tab 133*c* can be folded and inserted into the locking slot 152*b*, and then the locking tab 154*b* can be folded and inserted into the locking slot 135*c*. Though not shown, one or more locking tabs can extend from a side 142*a*, 142*b*, 144, and/or 141*f* of the second base 140 can be folded and inserted into a corresponding locking slot.

FIG. 3 depicts an isometric view of an illustrative container 300. The container 300 can be a derivative product of or can be formed from the panel board 100 and/or partially assembled container 200, discussed and described above with reference to FIGS. 1 and 2, respectively. For example, a first side boundary of a main body can be connected to a second side boundary of the main body by a connection flap extending from one of the side boundaries to the other, thereby providing a seam or overlap zone 324. The container 300 can have an upper boundary or top 370 and a lower boundary or bottom (shown in part at 341*c* and 341*d*). In one or more examples, the container 300 can be open or partially open about the upper boundary or top 370. The container 300 can have an internal volume generally disposed between the top of 370 the container 300 and the bottom of the container 300. For example, the internal volume of the container 300 can include the space disposed between the bottom side, the panels making up the main body, and a top side of the container 300.

The container 300 can include one or more handles (two are shown) 364. Each handle 364 can include one or more orifices, holes, or other passageways formed or otherwise disposed through one or more of the panels of the container 300. The handle 364 can be formed by a complete cut-out of the portion of the panel in which the handle 364 was formed therein, as depicted in FIG. 3. Alternatively, the handle 364 can partially be cut into the panel and then can be folded similar to the handle 164*a* or 164*b* shown in FIG. 1. The handle 364 can be disposed toward the upper boundary or top 370 of the container 300 and can be of a size and/or dimension suitable for a person to fit at least a portion their hand therein and/or therethrough. The handles 364 can be disposed in two opposing panels, which can allow a person to comfortably place a hand into each handle 364 and carry the container 300.

Referring to FIGS. 1-3, the panel board 100 to be positioned, folded, and assembled into the partially assembled container 200 and/or the container 300 and can have the following properties. The panel board 100 can include a single layer, two or more layers, three or more layers, four or more layers, five or more layers, six or more layers, or seven or more layers. For example, the panel board 100 can include a first or "outer" layer 340, a second or "middle" layer 350, and a third or "inner" layer 330.

As discussed and described above, the panel board 100 can be made of one or more sheets, or panels, of any known material, e.g., a fiberboard including paperboard, corrugated board, wood, plastic, or any combination thereof. For example, the panel board 100 can be made of cardboard, paperboard, foam board, or other suitable material. A method for producing the panel board 100 can include cutting the panel board 100 from a larger sheet of material. As a cut-out, the panel board 100 can have an outer boundary that is a hard edge. The method for producing the panel board 100 can also include making cuts in the panel board 100 to separate and/or distinguish the one or more support flaps 132, 134, 136, 138, the one or more bases 130, 140, the one or more locking tabs 133*a*-133*c* and 154*a*-154*c*, the one or more locking slots 135*a*-135*c* and 152*a*-152*c*, and/or the one or more connection flaps 124 from one another. For example, if the first base 130 has six sides, five of the six sides 131*a*-131*e* can be a cut or hard edge, and the remaining sixth side can be a folding line at the third segment 141*c*. Moreover, a side 131*a* of the first base 130 can be separated from a neighboring support flap 134 by making a cut therebetween. Similarly, another side 131*e* of the first base 130 can be separated from a neighboring support flap 136 by making a cut therebetween.

The material can include a single sheet or two or more layered sheets. The sheets can be flat, non-corrugated sheets, corrugated sheets, or a combination thereof. In one or more examples, the panel board 100 can be a corrugated linerboard made of a paperboard material having a first side, a second side, and a thickness determined by a distance between the first and second side. The panel board 100 can be a corrugated panel board that can include a first paperboard layer, a second paperboard layer, and a corrugated layer disposed between the first paperboard layer and the second paperboard layer. The corrugated panel board can include a first corrugating linerboard, a second corrugating linerboard, and a corrugated medium disposed therebetween. The corrugated medium can be bonded to the first and/or second linerboards by any suitable methods. For example, an adhesive can be used and located at the tips of the flutes of corrugated medium to bond the first and/or second linerboards to the corrugated medium. In other examples, a starch bond can be used to bond the first and/or second linerboards to corrugated medium, or a resin, such as DACREZ® resin from National Adhesives and Polymers, can be used as an additive to the starch in order to provide increased water/moisture resistance to the starch bond.

In one or more examples, the material of the panel board 100 can have any desired basis weight. One or more adhesives can be disposed on the panel board 100 at any desired location or combination of locations to provide, at least in part, adhesive bonding. For example, an adhesive can be disposed on the connection flap 124 and can be used to secure the first side boundary 125 to the second side boundary 127.

In one or more examples, the panel board 100 can include one or more sizing agents. The sizing agent can improve moisture resistance of the panel board 100. The sizing agent can be applied to one or more layers of the panel board 100 as a coating, as a laminate, as a polymer film extrudate, or any other suitable method. In one example, the sizing agent can be applied as a coating, specifically a water-based coating. Suitable water-based coatings include, but are not limited to, those formulations based on one or more styrene butadiene rubbers (SBR) or other styrene butadiene polymers. For example, the coatings can be or include, but are not limited to, VAPORCOAT® 340 and MICHEM® Coat 415 from Michelman, Inc.; TYKOTE® 1024 from Dow-Reichhold; EC442 from Enviro-coatings; NOVACOTE PC® 550G97; NOVACOTE PC® 550G00 from GP Chemicals; SPECTRAGUARD® 3003 from Spectra-Kote Corp.; and CARTASEAL® HFU from Clariant Corp. The material used to make the panel board 100 can include the linerboard, the moisture-repellant coating, and/or the linerboard can have moisture-repellant properties as discussed and described in U.S. Pat. No. 8,512,850.

In one or more examples, the sizing agent can include one or more clays, one or more clay-based materials, one or more rosins, one or more rosin-based materials, one or more latex materials, one or more latex-based materials, one or more starches, one or more modified starches, one or more gelatins, one or more waxes, one or more acrylic copolymers, one or more alkyl ketene dimers, one or more alkyl succinic anhydrides, one or more styrene maleic anhydride copolymers, one or more styrene maleimides, one or more styrene acrylic emulsions, one or more styrene acrylic acids, one or more ethylene acrylic acids, polyurethane, one or more polyurethane compositions, or any mixture thereof. Any one or more of the first layer 340, the second layer 350, or the third layer 330 of the panel board 100 can include one or more sizing agents disposed thereon, e.g., a coating, and/or incorporated therein. In one or more examples, the assembled container including one or more sizing agents can be sealed so that it does not leak water or any liquid contained therein.

The amount of sizing agent that can be applied to and/or incorporated in the panel board 100 can widely vary. For example, the sizing agent can be applied to and/or incorporated in the panel board 100 in an amount of about 1 lb/MSF (pound per thousand square feet), about 2 lb/MSF, about 3 lb/MSF, about 4 lb/MSF, or about 5 lb/MSF to about 6 lb/MSF, about 7 lb/MSF, about 8 lb/MSF, about 9 lb/MSF, about 10 lb/MSF, about 11 lb/MSF, about 12 lb/MSF, about 13 lb/MSF, about 14 lb/MSF, about 15 lb/MSF, about 16 lb/MSF, about 17 lb/MSF, about 18 lb/MSF, about 19 lb/MSF, about 20 lb/MSF, or more. In some examples, the sizing agent can be applied to and/or incorporated in the panel board 100 in an amount of about 1 lb/MSF to about 6 lb/MSF, about 3 lb/MSF to about 10 lb/MSF, about 2 lb/MSF to about 8 lb/MSF, about 7 lb/MSF to about 15 lb/MSF, about 4 lb/MSF to about 12 lb/MSF, about 10 lb/MSF to about 18 lb/MSF, or about 1 lb/MSF to about 20 lb/MSF.

The panel board 100 can have a water absorbency of about 0.05 $g/m^2$ (grams of water per square meter of the panel board 100), about 0.07 $g/m^2$, about 0.1 $g/m^2$, about 0.15 $g/m^2$, about 0.2 $g/m^2$, about 0.3 $g/m^2$, about 0.5 $g/m^2$, about 0.7 $g/m^2$, about 1 $g/m^2$, about 1.3 $g/m^2$, or about 1.5 $g/m^2$ to about 2 $g/m^2$, about 2.5 $g/m^2$, about 3 $g/m^2$, about 4 $g/m^2$, about 5 $g/m^2$, about 7 $g/m^2$, about 10 $g/m^2$, about 15 $g/m^2$, or about 20 $g/m^2$ or more, as measured according to the TAPPI/ANSI T 441 om-13. For example, the panel board 100 can have a water absorbency of less than 50 $g/m^2$, less than 45 $g/m^2$, less than 40 $g/m^2$, less than 35 $g/m^2$, less than 30 $g/m^2$, less than 25 $g/m^2$, less than 20 $g/m^2$, less than 15 $g/m^2$, less than 10 $g/m^2$, less than 7 $g/m^2$, less than 5 $g/m^2$, less than 4.5 $g/m^2$, less than 4 $g/m^2$, less than 3.5 $g/m^2$, less than 3 $g/m^2$, less than 2.5 $g/m^2$, less than 2 $g/m^2$, less than 1.5 $g/m^2$, less than 1 $g/m^2$, less than 0.7 $g/m^2$, less than 0.5 $g/m^2$, less than 0.3 $g/m^2$, less than 0.1 $g/m^2$, less than 0.07 $g/m^2$, less than 0.05 $g/m^2$, less than 0.01 $g/m^2$, less than 0.007 $g/m^2$, less than 0.005 $g/m^2$, less than 0.003 $g/m^2$, less than 0.001 $g/m^2$, less than 0.0007 $g/m^2$, less than 0.0005 $g/m^2$, less than 0.0003 $g/m^2$, or less than 0.0001 $g/m^2$, as measured according to the TAPPI/ANSI T 441 om-13. The panel board 100 can have a water absorbency that can be measured for a time of 180 seconds and a temperature of about 23° C. according to the Water Absorptiveness of Sized (Non-Bibulous) Paper, Paperboard, and Corrugated Fiberboard (Cobb test) test method, TAPPI/ANSI T 441 om-13, available from the Technological Association of the Pulp and Paper Industry (TAPPI).

Figure 4:
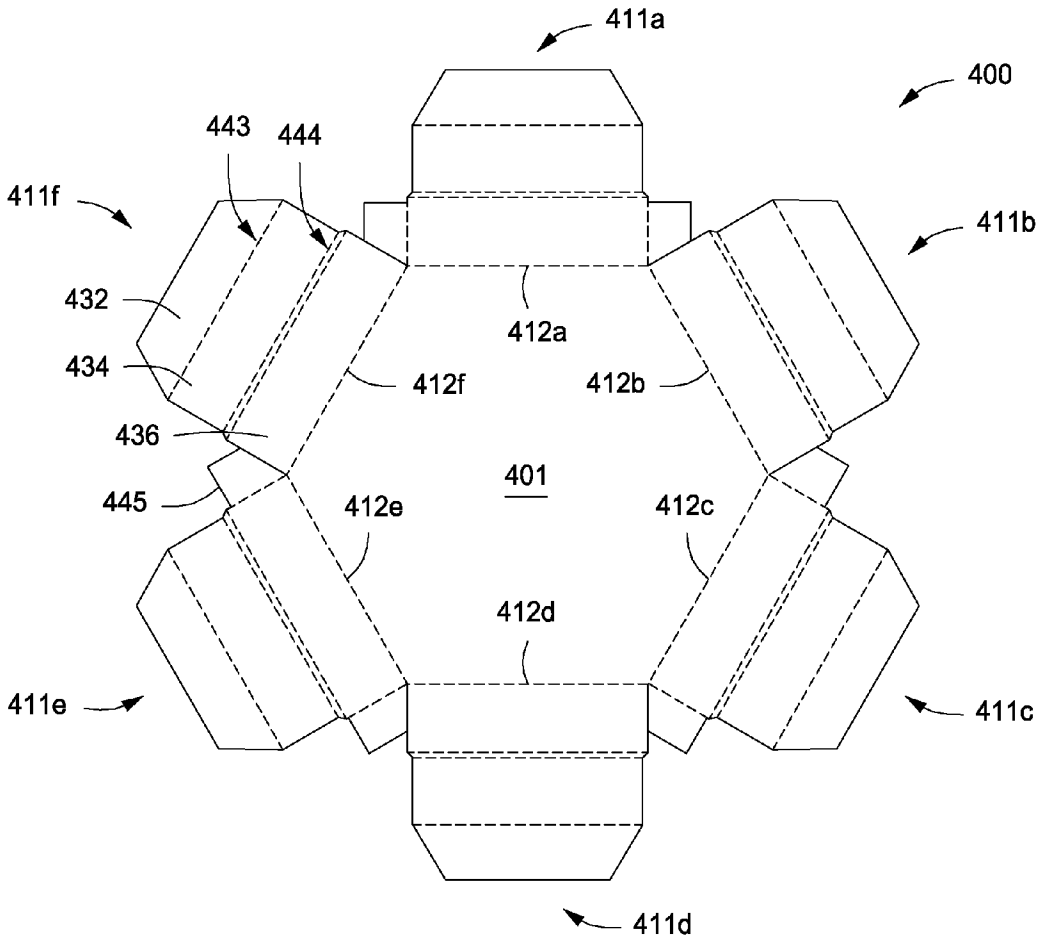
FIG. 4 depicts a perspective view of an illustrative lid panel, according to one or more embodiments described.

FIG. 4 depicts a perspective view of an illustrative lid panel 400. The lid panel 400 can generally be flat, and can include a front surface and a back surface. The lid panel 400 can be made of the same materials and have the same properties as the panel board 100, the partially assembled container 200, and/or the container 300 discussed and described above in reference to FIGS. 1-3. This can include, for example, the one or more fiberboard materials and layers, the one or more adhesives, the one or more sizing agents, or any combination thereof.

The lid panel 400 can include a base 401. The base 401 can have any number of sides. For example, the number of sides of the base 401 can be the same as the number of sides of the main body 102, e.g., the number of segments of the upper boundary 170 and/or lower boundary 141*a*-141*f* of the main body 102 of the container, as discussed and described above in reference to FIGS. 1-3. As such, the base can have generally the same dimensions (e.g., size and shape) as the upper boundary 170, 370 of the main body 102 of an assembled container 200, 300. The base 401 can have a boundary of three or more sides, four or more sides, five or more sides, six or more sides, seven or more sides, eight or more sides, nine or more sides, or ten or more sides. For example, the base 401 can have six or more sides 412*a*, 412*b*, 412*c*, 412*d*, 412*e*, 412*f*.

One or more lip units 411*a*-411*f* can extend from one or more of the sides 412*a*-412*f* of the base 401. Any side of the base 401 from which a lip unit 411*a*-411*f* extends can be or include a folding line. Each lip unit 411*a*-411*f* can include a body divided into one or more panels 432, 434, 436, and each panel 432, 434, 436 can be separated, divided, apportioned, distinguished, or otherwise shown to be different from each other by one or more boundary lines 443, 444. For example, the third panel 436 of the lip unit 411*a*-411*f* can extend from the side 412*a*-412*f* of the base 401, the second panel 434 of the lip unit 411*a*-411*f* can extend from an outer boundary line 444 of the third panel 436, and the first panel 432 can extend from an outer boundary line 443 of the second panel 434. Any of the boundary lines 443, 444 disposed between the panels 432, 434, 436 can be or include folding lines.

One or more locking flaps 445 can extend from a first side boundary and/or a second side boundary of any one or more of the panels 432, 434, 436 of any of the lip units 411*a*-411*f*. In such examples, the first side boundary and/or the second side boundary of the panel 432, 434, 436 can be or include a folding line, which can be as discussed and described above in reference to FIG. 1. More particularly, the one or more locking flaps 445 can extend from a first side and/or a second side of the first panel 432, a first side and/or a second side of the second panel 434, a first side and/or a second side of the third panel 436, or any combination thereof. As shown in FIG. 4, the locking flaps 445 can extend from the first and second sides of the third panels 436 of the first lip unit 411*a*, third lip unit 411*c*, and sixth lip unit 411*e*. In one or more examples, a lip unit can be absent from one or more of the sides 412*a*-412*f* of the base 401 of the lid.

The lid panel 400 can be assembled to form a lid according to one or more methods. The lid 400, when assembled, can serve as a lid, cap, top, hood, roof, or otherwise at least partially cover the opening at the top of the container 300 as discussed and described above in reference to FIG. 3. As such, the dimensions of the lid panel 400 can be selected to correspond or otherwise be proportional to the dimensions of the container 300.

For example, the method can include assembling the one or more lip units 411*a*-411*f* and securing the lip units 411*a*-411*f* to one another with the one or more locking flaps 445. Assembly of the lip unit 411*a*-411*f* can include folding the first panel 432 over the second panel 434, which can be accomplished by folding along the boundary line 443 so that the first panel 432 overlays or otherwise lays onto the second panel 434. The first and second panels 432, 434 can then be folded over the third panel 436, which can be accomplished by folding along the boundary line 444 so that the first and second panels 423, 434 overlay or otherwise lays onto the third panel 436. Due to the thickness of the first and second panels 432, 434, the boundary line 444 separating the second panel 434 and the third panel 436 can include two or more folding lines so that all of the panels 432, 434, 436 can lay flatly against one another.

The locking flaps 445 can then be folded to secure the assembled lip units 411*a*-411*f* to one another. The locking flaps 445 can be configured to keep the lip units 411*a*-411*f* folded along the boundary lines 443, 444, and/or to secure one lip unit 411*a*-411*f* to a neighboring lip unit 411*a*-411*f*. In one or more examples, an adhesive can be used to maintain the assembly of the lid. For example, an adhesive can be placed between the first and second panels 432, 434, an adhesive can be placed between the first and third panels 432, 436, an adhesive can be placed between the locking flap 445 and any one of the first, second, or third panels 432, 434, 436, or any combination thereof.

Though not shown, in one or more examples, the lid panel 400 can be attached to or otherwise part of the same panel board 100 as discussed and described above. One or more portions of the lid panel 400, e.g., a lip unit 411*a*-411*f* or an side 412*a*-412*f* of the base 401, can extend from or otherwise be fastened, attached, or otherwise connected to the panel board 100. The lid can be fastened, attached, or otherwise connected to the panel board 100 in a variety of ways. In one or more examples, the lid panel 400 and the panel board 100 can be a single cut-out such that the lid panel 400 and panel board 100 are not separate from one another. In such a configuration, a single side 412*a*-412*f* of the base 401 of the lid can be directly attached to, and thus extend from, a segment of the upper boundary of the main body of the container, and the segment of the upper boundary can be or include a folding line. The lid can be "opened" and "closed" by folding along the folding line. This configuration has the benefit of providing a user with a container that has a connected lid, which may prevent loss or damage to the lid. To "open" the interior of the container, the lid may be folded back along the folding line to make the interior of the container available for access. To "close" the container, the lid may be closed by folding along the folding line to make the interior of the container unavailable for access.

Though not shown, the lid panel 400 can also include one or more handles disposed thereon. For example, a handle can be disposed on the front surface and/or the back surface of the lid panel 400, or a handle can be disposed in the lid panel 400 so that a person can more easily open and/or close the lid. A handle on the top side of the lid can benefit a person by providing an easier, or at least an alternative, way to open, close, or otherwise handle the lid.

The lid panel 400 can be made from of one or more sheets, or panels, of any known material, e.g., a fiberboard including paperboard, corrugated board, wood, plastic, or any combination thereof. For example, the lid panel 400 can be made of cardboard, paperboard, foam board, or other suitable material. The lid panel 400 can be made from the same or similar materials and the panel board 100. The lid panel 400 can be made from the same material and can be produced by the same methods as the panel board discussed and described above. For example, the lid panel 400 can be but from the same sheet of material that the panel board 100 was cut from.

Figure 5:
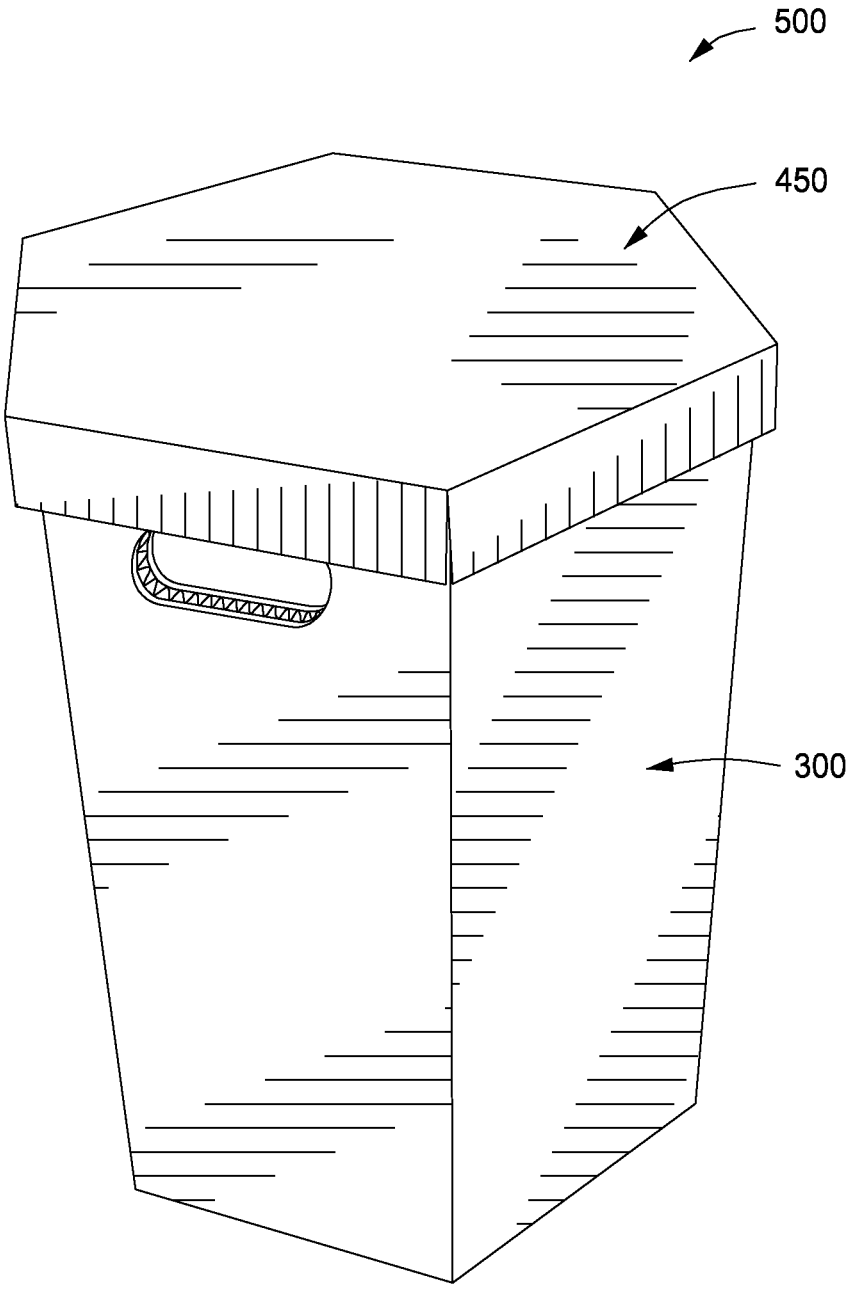
FIG. 5 depicts an isometric view of an illustrative container and lid, according to one or more embodiments.

FIG. 5 depicts a perspective view of an illustrative container 500 including the container 300 and a lid 450 placed thereon. The lid 450 can be a derivative product of or can be formed from the lid panel 400 discussed and described above in reference to FIG. 4. As discussed above, the dimensions of the lid 450 can be selected based, at least in part, on the dimensions of the container 300. In considering the dimensions of the container 300, the lid 450 can be cut, or otherwise formed, so that, when assembled, the lid 450 can be placed and fit onto the top of the container 300. In one or more examples, the one or more lip units of the lid 450 can overlap the top of the container 300. The lip units can overlap the outer surface and/or the inner surface of the top of the container 300.

Figure 6:
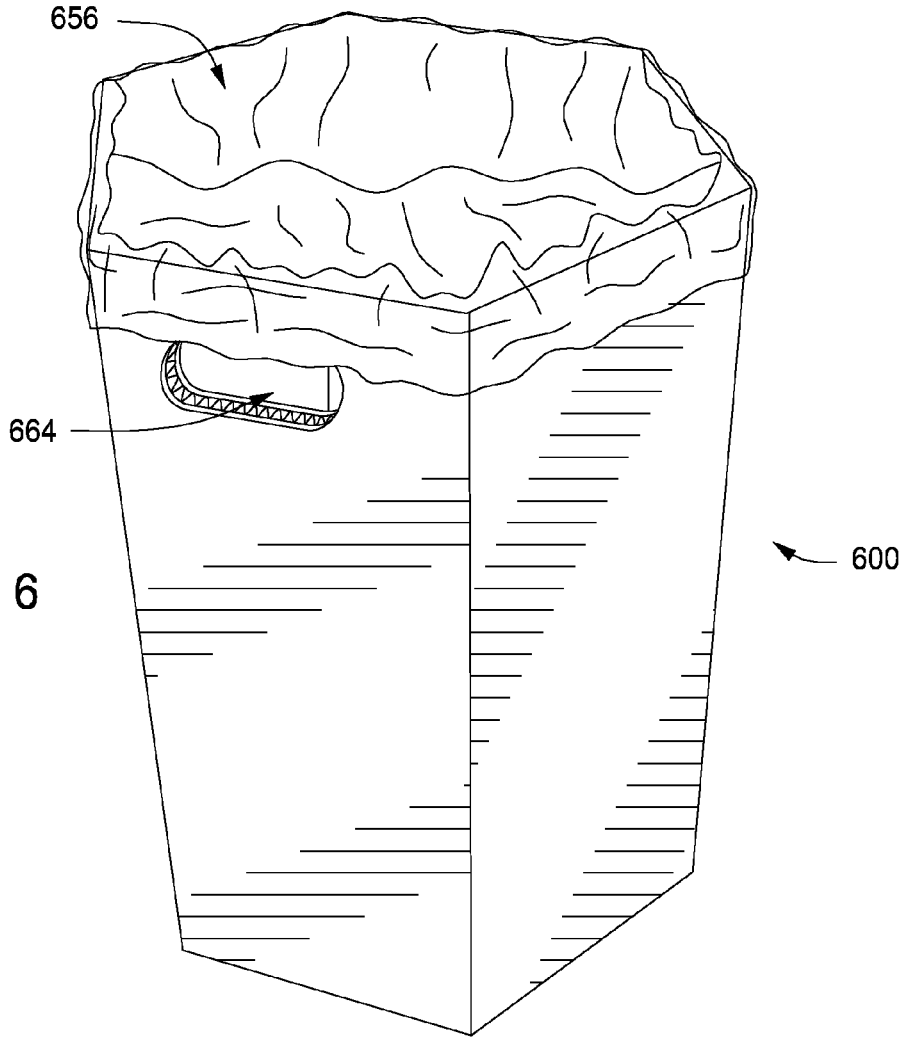
FIG. 6 depicts an isometric view of an illustrative container having a barrier disposed therein, according to one or more embodiments described.

FIG. 6 depicts a perspective view of an illustrative container 600 having a barrier 656 disposed therein. The container 600, including the addition of the barrier 656, can provide thermal and/or radiant protection to any contents placed within the container 600. Though not shown, the assembled container 600 having a barrier 656 disposed therein can include a lid, which can be as discussed and described above in reference to FIGS. 4 and 5. The barrier 656 can be one or more sheets of material that can be glued to or placed on an inner surface of the container 600 or the barrier 656 can be in the form of a bag that can be disposed or otherwise secured within the container 600. The barrier 656 can be removable, such that the barrier 656 can be removed from the container 600 and replaced with another barrier.

In one or more examples, the barrier 656 can be a plastic bag. The plastic bag can be made of a transparent material. The barrier 656 can be connected to, attached to, or otherwise disposed within the container 600 in a variety of configurations. For example, a bottom section of the barrier 656 can be placed within the internal volume of the container 600 and a top section of the barrier 656 can be folded over the top of the container 600. In other words, at least a portion of the barrier 656 can be disposed within the internal volume of the container 600. A draw string can be disposed within the top section of the barrier 656, and the barrier 656 can be secured to the container 600 by tightening the drawstring. For example, the top section of the barrier 656 can be secured to the top of the inner surface and/or outer surface of the container 600. In one or more examples, an adhesive can be used to secure the barrier 656 to an inner surface of the container 600 and/or the outer surface of the container 600. For example, the barrier 656 can include an adhesive layer, which can be used to attach any portion of the barrier to the inner and/or outer surface of the container 600. The barrier 656 can also include a stretched polyester film, which can be disposed inside the container 600 to provide a radiant barrier, where the stretched polyester film can include biaxially oriented polyethylene and/or terephthalate.

In one or more examples, the barrier 656 can include a material suitable to hold any desired item, e.g., liquids and/or solids, placed within the inner volume of the container 600, while helping to maintain the integrity of the container 600. For example, the barrier 656 can prevent a liquid disposed therein from coming into contact with the container 600. The barrier 656 can protect against damage caused by humidity, moisture, oxygen, salt spray, aromas, grease, and other airborne contaminants. For example, ice and beverage containers (e.g., cans and/or bottles of water, soft drinks, and/or alcoholic beverages) can be placed within a container 600 made of paperboard. As the ice melts, the barrier 656 can prevent water from coming into contact with the paperboard, preventing the paperboard from becoming soggy and weak.

The container 600 can include one or more handles (one is shown) 664. Each handle 664 can include one or more orifices, holes, or other passageways formed or otherwise disposed through one or more of the panels. As shown in FIG. 6, the handle 664 can be formed by a complete cut-out of the panel the handle 664 is located in. The handle 664 can be disposed toward the top of the container 600 and can be of a size and/or dimension suitable for a person to fit at least a portion their hand therein and/or therethrough. The handles 664 can be disposed in two opposing panels, which can allow a person to comfortably place a hand into each handle 664 and carry the container 600.

Figure 7:
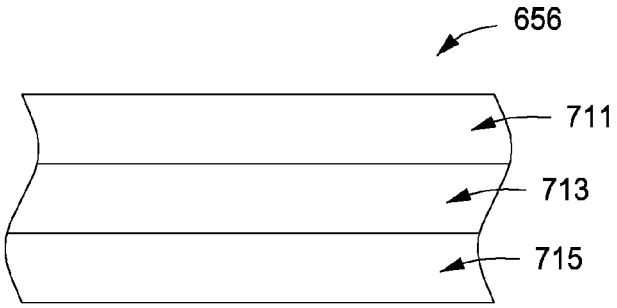
FIG. 7 depicts a cross-sectional view of the illustrative barrier shown in FIG. 6.

FIG. 7 depicts a cross-sectional view of the barrier 656 shown in FIG. 6. The barrier 656 can include a plurality of layers. For example, the barrier 656 can include a first or "inner" layer 711, a second or "middle" layer 713, and a third or "outer" layer 715. In one or more examples, the barrier 656 can be a plastic bag. The barrier 656 can include a radiant barrier. For example, the inner layer 711 and/or the outer layer 715 can be a radiant barrier material and the middle layer 713 can be a polymer material.

The barrier 656 can be made of a variety of materials. For example, the barrier 656 can be or include a poly foil laminate water-vapor proof barrier material. In another example, the barrier 656 can be or include a poly kraft foil laminate water-vapor proof barrier material. In some examples, the barrier 656 can be or include a woven scrim foil laminate water-vapor proof barrier material. The barrier 656 can meet military grade protective foil standards, including MIL-PRF-131k class 1, class 2, and/or class 3, which can be purchased from a plurality of manufacturers, including Royce Packaging, Inc., and EDCO Supply Corp.

The barrier 656 can be made of polylactic acid and of one or more of the following materials: polyethylene, high-density polyethylene, low-density polyethylene, linear low-density polyethylene, polypropylene, biaxially oriented polypropylene, polyester, or polyvinyl chloride. The barrier 656 can include a biodegradable radiant barrier on the first layer of the barrier 656. In another example, the biodegradable radiant barrier can be disposed on the second, outer layer of the barrier 656. Both the first, inner layer and the second, outer layer of the barrier 656 can include the biodegradable radiant barrier.

Embodiments of the present disclosure further relate to any one or more of the following paragraphs:

1. A panel board, comprising a main body comprising a front surface and a back surface, wherein the main body is confined by an upper boundary, a lower boundary, a first side boundary, and a second side boundary, and wherein each of the first side boundary and the second side boundary extend between the upper boundary and the lower boundary, and the second side boundary extends between the upper boundary and the lower boundary; a first folding line disposed on the front surface and extending between the upper boundary and the lower boundary, wherein a first panel is confined between the first side boundary, the first folding line, the upper boundary, and the lower boundary; a second folding line disposed on the front surface and extending between the upper boundary and the lower boundary, wherein a second panel is confined between the first folding line, the second folding line, the upper boundary, and the lower boundary; a third folding line disposed on the front surface and extending between the upper boundary and the lower boundary, wherein a third panel is confined between the second folding line, the third folding line, the upper boundary, and the lower boundary; a fourth folding line disposed on the front surface and extending between the upper boundary and the lower boundary, wherein a fourth panel is confined between the third folding line, the fourth folding line, the upper boundary, and the lower boundary; a fifth folding line disposed on the front surface and extending between the upper boundary and the lower boundary, wherein a fifth panel is confined between the fourth folding line, the fifth folding line, the upper boundary, and the lower boundary, and where a sixth panel is confined between the fifth folding line, the second side boundary, the upper boundary, and the lower boundary; a first base extending from the lower boundary of the main body, wherein the first base has six or more sides, wherein a first locking tab extends from a first side of the six or more sides of the first base, and wherein a second locking tab extends from a second side of the six or more sides of the first base; a third locking tab extending from the lower boundary of the main body; and a first locking slot and a second locking slot, each disposed through the panel board about the lower boundary of the main body.

2. The panel board according to paragraph 1, further comprising a connection flap extending from the first side boundary or the second side boundary of the main body, wherein the connection flap is configured to couple the first side boundary and the second side boundary to one another.

3. The panel board according to paragraph 1 or 2, further comprising a second base and a plurality of support flaps, wherein the second base and each of the support flaps extend from the lower boundary of the main body.

4. The panel board according to any one of paragraphs 1 to 3, where the main body of the panel board is configured to form a main body of a container by connecting the first side boundary to the second side boundary, and wherein the first base, the second base, and the plurality of support flaps is configured to form a bottom side of the container.

5. The panel board according to any one of paragraphs 1 to 4, further comprising a second base and four support flaps, wherein the first base extends from the lower boundary at the third panel, wherein the second base extends from the lower boundary at the sixth panel, wherein a first support flap of the four support flaps extends from the lower boundary at the first panel, wherein a second support flap of the four support flaps extends from the lower boundary at the second panel, wherein a third support flap of the four support flaps extends from the lower boundary at the fourth panel, and wherein a fourth support flap of the four support flaps extends from the lower boundary at the fifth panel.

6. The panel board according to any one of paragraphs 1 to 5, further comprising a first handle disposed through one of the panels and a second handle disposed through another of the panels that is different than the panel having the first handle.

7. The panel board according to any one of paragraphs 1 to 6, further comprising a third locking slot disposed through the first locking tab and a fourth locking slot disposed through the second locking tab.

8. The panel board according to any one of paragraphs 1 to 7, wherein the first locking tab is configured to insert into the first locking slot, and wherein the second locking tab is configured to insert into the second locking slot.

9. A product comprising the panel board according to any one of paragraphs 1 to 8; and a lid panel having a front surface and a back surface.

10. The product according to paragraph 9, wherein the lid panel comprises a lid base having six sides, wherein a lip unit extends from each of the six sides of the lid base, wherein at least one folding line is disposed between each of the lip unit and the lid base.

11. A container, comprising a main body comprising an upper boundary and a lower boundary; six or more panels comprising a first panel, a second panel, a third panel, a fourth panel, a fifth panel, and a sixth panel, wherein the panels are separated from one another by folding lines, and wherein each panel extends between the upper boundary and the lower boundary; one or more locking slots, each disposed through the main body about the lower boundary of the main body; and a bottom side comprising a first layer, wherein the first layer comprises a first base connected to the lower boundary of the main body at the third panel, wherein the first base comprises six or more sides, wherein one or more locking tabs extend from one or more of the sides of the first base, and wherein each locking tab is disposed through one of the locking slots.

12. The container according to paragraph 11, wherein the bottom side further comprises a second layer, and wherein the second layer comprises a first support flap connected to the lower boundary of the main body at the second first; a second support flap connected to the lower boundary of the main body at the second panel; a third support flap connected to the lower boundary of the main body at the fourth panel; and a fourth support flap connected to the lower boundary of the main body at the fifth panel.

13. The container according to paragraphs 11 or 12, wherein the bottom side further comprises a third layer, wherein the third layer comprises a second base, and wherein the second base is connected to the lower boundary of the main body at the sixth panel.

14. The container according to any one of paragraphs 11 to 13, wherein the container is assembled from a flat panel board, and wherein each folding line independent is a mark, a pencil or ink line, a groove, a score, a scratch, a perforation, a bulge, a bend, an indentation, or a crease.

15. The container according to any one of paragraphs 11 to 14, further comprising a first handle disposed through one of the panels and a second handle disposed through another of the panels that is different than the panel having the first handle.

16. The container according to any one of paragraphs 11 to 15, further comprising a lid.

17. The container according to any one of paragraphs 11 to 16, further comprising a barrier at least partially disposed within the internal volume of the container, wherein the barrier comprises a radiant barrier.

18. A method for assembling a container, comprising positioning a panel board, wherein the panel board comprises a main body comprising a front surface and a back surface, wherein the main body is confined by an upper boundary, a lower boundary, a first side boundary, and a second side boundary, and wherein the first side boundary extends between the upper boundary and the lower boundary, and the second side boundary extends between the upper boundary and the lower boundary; a first folding line disposed on the front surface and extending between the upper boundary and the lower boundary, wherein a first panel is confined between the first side boundary, the first folding line, the upper boundary, and the lower boundary; a second folding line disposed on the front surface and extending between the upper boundary and the lower boundary, wherein a second panel is confined between the first folding line, the second folding line, the upper boundary, and the lower boundary; a third folding line disposed on the front surface and extending between the upper boundary and the lower boundary, wherein a third panel is confined between the second folding line, the third folding line, the upper boundary, and the lower boundary; a fourth folding line disposed on the front surface and extending between the upper boundary and the lower boundary, wherein a fourth panel is confined between the third folding line, the fourth folding line, the upper boundary, and the lower boundary; a fifth folding line disposed on the front surface and extending between the upper boundary and the lower boundary, wherein a fifth panel is confined between the fourth folding line, the fifth folding line, the upper boundary, and the lower boundary, and wherein a sixth panel is confined between the fifth folding line, the second side boundary, the upper boundary, and the lower boundary; a first base extending from the lower boundary of the main body about a sixth folding line, wherein the first base has six or more sides, wherein a first locking tab extends from a first side of the six or more sides of the first base, and wherein a second locking tab extends from a second side of the six or more sides of the first base; a second base extending from the lower boundary of the main body about a seventh folding line; a third locking tab extending from the lower boundary of the main body; and a first locking slot and a second locking slot, each disposed through the panel board about the lower boundary of the main body; connecting the first side boundary of the main body to the second side boundary of the main body; folding the main body at the first, second, third, fourth, and fifth folding lines to provide an internal volume; folding the first base and the second base across the internal volume to provide a bottom side of the container; and inserting the first locking tab into the first locking slot and the second locking tab into the second locking slot.

19. The method according to paragraph 18, wherein the panel board further comprises a lid extending from the upper boundary of the main body about an eighth folding line.

20. The method according to paragraph 18 or 19, further comprising folding the lid across the internal volume of the container.

21. The method according to any one of paragraphs 18 to 20, further comprising assembling a lid, comprising folding a lid panel, wherein the lid panel comprises a lid base having six sides, a lip unit extending from each of the six sides of the lid base, and at least one folding line is disposed between each lip unit and the lid base.

22. The method according to any one of paragraphs 18 to 21, further comprising placing the lid on a top side of the container.

23. A panel board, comprising a main body comprising a front surface and a back surface, wherein the main body is confined by an upper boundary, a lower boundary, a first side boundary, and a second side boundary, and wherein the first side boundary extends between the upper boundary and the lower boundary, and the second side boundary extends between the upper boundary and the lower boundary; a first folding line extending between the upper boundary and the lower boundary, wherein a first panel is confined between the first side boundary, the first folding line, the upper boundary, and the lower boundary; a second folding line extending between the upper boundary and the lower boundary, wherein a second panel is confined between the first folding line, the second folding line, the upper boundary, and the lower boundary; a third folding line extending between the upper boundary and the lower boundary, wherein a third panel is confined between the second folding line, the third folding line, the upper boundary, and the lower boundary; a fourth folding line extending between the upper boundary and the lower boundary, wherein a fourth panel is confined between the third folding line, the fourth folding line, the upper boundary, and the lower boundary; a fifth folding line extending between the upper boundary and the lower boundary, wherein a fifth panel is confined between the fourth folding line, the fifth folding line, the upper boundary, and the lower boundary, and wherein a sixth panel is confined between the fifth folding line, the second side boundary, the upper boundary, and the lower boundary; a first base extending from the lower boundary of the main body, wherein the first base has six or more sides, wherein a first locking tab extends from one of the six or more sides of the first base, and wherein a second locking tab extends from another one of the six or more sides of the first base; a second base extending from the lower boundary of the main body; a third locking tab extending from the lower boundary of the main body; and a first locking slot and a second locking slot, each disposed through the lower boundary of the main body.

24. The panel board of paragraph 23, further comprising a third locking slot disposed through at least one of the first or second locking tabs.

25. The panel board of paragraph 23 or 24, further comprising one or more support flaps extending from the lower boundary of the main body.

26. The panel board according to any one of paragraphs 23 to 25, wherein the main body is configured to fold into a container having an internal volume.

27. The panel board according to any one of paragraphs 23 to 26, wherein the first base and the second base are configured to form a bottom side of the container.

28. The panel board according to any one of paragraphs 23 to 27, wherein the first and second locking tabs are configured to insert into the first and second locking slots.

29. The panel board according to any one of paragraphs 23 to 28, wherein the panel board is configured to be assembled into a container, wherein the main body of the panel board composes side walls of the container, and wherein the first and second bases compose the bottom side of the container.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A panel board, comprising:

a main body comprising a front surface and a back surface, wherein the main body is confined by an upper boundary, a lower boundary, a first side boundary, and a second side boundary, and wherein each of the first side boundary and the second side boundary extend between the upper boundary and the lower boundary;

a first folding line disposed on the front surface and extending between the upper boundary and the lower boundary, wherein a first panel is confined between the first side boundary, the first folding line, the upper boundary, and the lower boundary;

a second folding line disposed on the front surface and extending between the upper boundary and the lower boundary, wherein a second panel is confined between the first folding line, the second folding line, the upper boundary, and the lower boundary;

a third folding line disposed on the front surface and extending between the upper boundary and the lower boundary, wherein a third panel is confined between the second folding line, the third folding line, the upper boundary, and the lower boundary;

a fourth folding line disposed on the front surface and extending between the upper boundary and the lower boundary, wherein a fourth panel is confined between the third folding line, the fourth folding line, the upper boundary, and the lower boundary;

a fifth folding line disposed on the front surface and extending between the upper boundary and the lower boundary, wherein a fifth panel is confined between the fourth folding line, the fifth folding line, the upper boundary, and the lower boundary, and wherein a sixth panel is confined between the fifth folding line, the second side boundary, the upper boundary, and the lower boundary;

a first base extending from the lower boundary of the third panel, wherein the first base has six or more sides, wherein a first locking tab extends from a first side of the six or more sides of the first base, and wherein a second locking tab extends from a second side of the six or more sides of the first base;

a second base extending from the lower boundary of the main body at the sixth panel;

a first support flap extending from the lower boundary of the main body at the first panel;

a second support flap extending from the lower boundary of the main body at the second panel;

a third support flap extending from the lower boundary of the main body at the fourth panel, a fourth support flap extending from the lower boundary of the main body at the fifth panel;

a third locking tab extending from the lower boundary of the main body; and a first locking slot and a second locking slot, each disposed through the panel board about the lower boundary of the main body.

2. The panel board of claim 1, further comprising a connection flap extending from the first side boundary or the second side boundary of the main body, wherein the connection flap is configured to couple the first side boundary and the second side boundary to one another.

3. The panel board of claim 1, wherein the main body of the panel board is configured to form a main body of a container by connecting the first side boundary to the second side boundary, and wherein the first base, the second base, the first support flap, the second support flap, the third support flap, and the fourth support flap are configured to form a bottom side of the container.

4. The panel board of claim 1, further comprising a first handle disposed through one of the panels and a second handle disposed through another of the panels that is different than the panel having the first handle.

5. The panel board of claim 1, further comprising a third locking slot disposed through the first locking tab and a fourth locking slot disposed through the second locking tab.

6. The panel board of claim 5, wherein the first locking tab is configured to insert into the first locking slot, and wherein the second locking tab is configured to insert into the second locking slot.

7. A product, comprising:

the panel board of claim 1; and a lid panel having a front surface and a back surface.

8. The product of claim 7, wherein the lid panel comprises a lid base having six sides, wherein a lip unit extends from each of the six sides of the lid base, and wherein at least one folding line is disposed between each of the lip unit and the lid base.

9. The panel board of claim 1, further comprising a barrier disposed on the front surface, wherein the barrier comprises a radiant barrier.

10. A container, comprising:

a main body comprising:

an upper boundary and a lower boundary;

six or more panels comprising a first panel, a second panel, a third panel, a fourth panel, a fifth panel, and a sixth panel, wherein the panels are separated from one another by folding lines, and wherein each panel extends between the upper boundary and the lower boundary;

one or more locking slots, each disposed through the main body about the lower boundary of the main body;

a bottom side comprising a first layer, wherein the first layer comprises a first base connected to the lower boundary of the main body at the third panel, wherein the first base comprises six or more sides, wherein one or more locking tabs extend from one or more of the sides of the first base, and wherein each locking tab is disposed through one of the locking slots and a barrier at least partially disposed within an internal volume of the container, wherein the barrier comprises a radiant barrier.

11. The container of claim 10, wherein the bottom side further comprises a second layer, and wherein the second layer comprises:

a first support flap connected to the lower boundary of the main body at the first panel;

a second support flap connected to the lower boundary of the main body at the second panel;

a third support flap connected to the lower boundary of the main body at the fourth panel; and a fourth support flap connected to the lower boundary of the main body at the fifth panel.

12. The container of claim 10, wherein the container is assembled from a flat panel board, and wherein each folding line is independently a mark, a pencil or ink line, a groove, a score, a scratch, a perforation, a bulge, a bend, an indentation, or a crease.

13. The container of claim 10, further comprising a first handle disposed through one of the panels and a second handle disposed through another of the panels that is different than the panel having the first handle.

14. The container of claim 10, further comprising a lid.

15. A container, comprising:

a main body comprising:

an upper boundary and a lower boundary;

six or more panels comprising a first panel, a second panel, a third panel, a fourth panel, a fifth panel, and a sixth panel, wherein the panels are separated from one another by folding lines, and wherein each panel extends between the upper boundary and the lower boundary;

one or more locking slots, each disposed through the main body about the lower boundary of the main body; and a bottom side comprising a first layer, a second layer, and a third layer, wherein the first layer comprises a first base connected to the lower boundary of the main body at the third panel, wherein the first base comprises six or more sides, wherein one or more locking tabs extend from one or more of the sides of the first base, and wherein each locking tab is disposed through one of the locking slots, wherein the second layer comprises:

a first support flap connected to the lower boundary of the main body at the first panel, a second support flap connected to the lower boundary of the main body at the second panel, a third support flap connected to the lower boundary of the main body at the fourth panel, and a fourth support flap connected to the lower boundary of the main body at the fifth panel, and wherein the third layer comprises a second base connected to the lower boundary of the main body at the sixth panel.

16. The method of claim 15, wherein a barrier is at least partially disposed within an internal volume of the container, and wherein the barrier comprises a radiant barrier.

17. A method for assembling a container, comprising:

positioning a panel board, wherein the panel board comprises:

a main body comprising a front surface and a back surface, wherein the main body is confined by an upper boundary, a lower boundary, a first side boundary, and a second side boundary, and wherein each of the first side boundary and the second side boundary extend between the upper boundary and the lower boundary;

a first folding line disposed on the front surface and extending between the upper boundary and the lower boundary, wherein a first panel is confined between the first side boundary, the first folding line, the upper boundary, and the lower boundary;

a second folding line disposed on the front surface and extending between the upper boundary and the lower boundary, wherein a second panel is confined between the first folding line, the second folding line, the upper boundary, and the lower boundary;

a third folding line disposed on the front surface and extending between the upper boundary and the lower boundary, wherein a third panel is confined between the second folding line, the third folding line, the upper boundary, and the lower boundary;

a fourth folding line disposed on the front surface and extending between the upper boundary and the lower boundary, wherein a fourth panel is confined between the third folding line, the fourth folding line, the upper boundary, and the lower boundary;

a fifth folding line disposed on the front surface and extending between the upper boundary and the lower boundary, wherein a fifth panel is confined between the fourth folding line, the fifth folding line, the upper boundary, and the lower boundary, and wherein a sixth panel is confined between the fifth folding line, the second side boundary, the upper boundary, and the lower boundary;

a first base extending from the lower boundary of the main body about a sixth folding line, wherein the first base has six or more sides, wherein a first locking tab extends from a first side of the six or more sides of the first base, and wherein a second locking tab extends from a second side of the six or more sides of the first base;

a second base extending from the lower boundary of the main body about a seventh folding line;

a third locking tab extending from the lower boundary of the main body; and a first locking slot and a second locking slot, each disposed through the panel board about the lower boundary of the main body;

folding the main body at the first, second, third, fourth, and fifth folding lines;

connecting the first side boundary of the main body to the second side boundary of the main body to provide an internal volume;

folding the first base and the second base across the internal volume to provide a bottom side of the container;

inserting the first locking tab into the first locking slot and the second locking tab into the second locking slot; and at least partially disposing a barrier within the internal volume of the container, wherein the barrier comprises a radiant barrier.

18. The method of claim 17, further comprising assembling a lid, comprising:

folding a lid panel, wherein the lid panel comprises:

a lid base having six sides, a lip unit extending from each of the six sides of the lid base, and at least one folding line is disposed between each lip unit and the lid base.

19. The method of claim 18, further comprising placing the lid on a top side of the container.

20. The method of claim 17, wherein the panel board further comprises a first support flap, a second support flap, a third support flap, and a fourth support flap, wherein:

the first base extends from the lower boundary of the third panel, the second base extends from the lower boundary of the sixth panel, the first support flap extends from the lower boundary of the first panel, the second support flap extends from the lower boundary of the second panel, the third support flap extends from the lower boundary of the fourth panel, and the fourth support flap extends from the lower boundary of the fifth panel.

* * * * *